United States Patent [19]

Shaw

[11] Patent Number: 4,702,283

[45] Date of Patent: Oct. 27, 1987

[54] PROCESS AND APPARATUS FOR INSPECTING WOVEN FABRIC DURING ITS PRODUCTION ON ONE OR MORE LOOMS

[75] Inventor: Henri Shaw, Woesten-Vleteren, Belgium

[73] Assignee: N.V. Weefautomaten Picanol, Belgium

[21] Appl. No.: 878,225

[22] Filed: Jun. 25, 1986

[30] Foreign Application Priority Data

Jun. 26, 1985 [BE] Belgium ..... 2/60724

[51] Int. Cl.[4] ..... D03D 51/18

[52] U.S. Cl. ..... 139/348; 139/304; 139/336; 66/166; 250/563

[58] Field of Search ..... 139/336, 348, 311, 304; 356/238, 431; 250/562, 563; 66/166

[56] References Cited

U.S. PATENT DOCUMENTS

| | | | |
|---|---|---|---|
| 3,417,252 | 12/1968 | Nickell et al. | 66/166 |
| 3,613,743 | 10/1971 | Sakamoto | 139/348 |
| 3,657,727 | 4/1972 | Blevins | 250/563 |
| 4,178,969 | 12/1979 | Gotoh et al. | 139/336 |
| 4,361,171 | 11/1982 | Fukuda | 139/348 |
| 4,593,725 | 6/1986 | Alexander | 139/311 |

*Primary Examiner*—Henry S. Jaudon

*Attorney, Agent, or Firm*—Bacon & Thomas

[57] ABSTRACT

Optical scanning and inspection of loomed fabric on one or more looms is carried out using a travelling optical scanner that scans an inspection area of fabric on a loom faster than the fabric traverses the inspection area, such inspection area provided between the weaving portion of the loom and the fabric take-up roll. The scanner generates signals that can routinely be compared with preset reference standards and which can be used to control the stopping of the loom upon the detection of a weaving defect. Fabric moving through multiple looms can be scanned in sequence by a scanner traversing multiple inspection areas of the looms.

12 Claims, 3 Drawing Figures

PROCESS AND APPARATUS FOR INSPECTING WOVEN FABRIC DURING ITS PRODUCTION ON ONE OR MORE LOOMS

BACKGROUND OF THE INVENTION

The present invention relates to a process and apparatus for optically inspecting fabrics produced by one or more weaving looms in order to observe weaving defects as soon as possible after weaving the fabric and to provide signals to control the stopping of the loom in the event of observation of a weaving defect.

Presently, a loom operator controls a number of weaving looms and regularly inspects visually the fabric produced on the looms in order to observe weaving defects in the warp, for instance due to a faulty passed warp thread, or pick defects which repeat themselves. If a defect is observed, the operator takes appropriate action to control, i.e., stop, the loom.

It is clear, however, that due to the higher speed of loom operation in modern times, and the larger number of looms controlled by one weaver, it is increasingly difficult to exert quality control by simple visual observance by the weaver. This invention proposes a solution to the problem using an automatic inspection station on the loom for optically inspecting the fabric during its production.

The process according to the present invention mainly consists of guiding the woven fabric through an inspection station between the weaving section of the loom and the fabric take-up roll, the inspection station including a fabric inspection area over which the fabric extends for observation; causing an optical sensor to scan the entire inspection area of the fabric during each inspection cycle and to generate a weaving quality signal; comparing the weaving quality signal observed by the scanner with one or more set comparison or reference standards, i.e., weaving quality reference values; and, upon the indication of a weaving quality fault, as indicated by the weaving quality signal from the scanner differing substantially from the reference standard, stopping the loom. The invention also relates to the inspection system itself used to carry out the above process.

DETAILED DESCRIPTION

Figure 1:
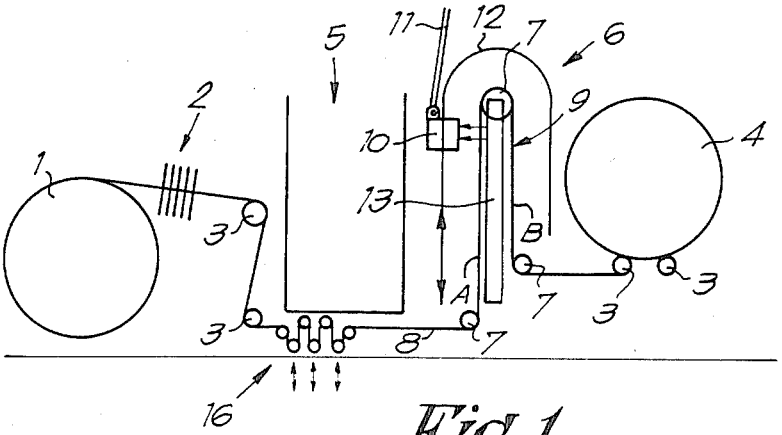
FIG. 1 schematically illustrates a first embodiment of an inspection system using a vertically oriented inspection area.

As shown in FIG. 1, a weaving installation is illustrated including loom components such as a warp supply roll 1, weaving area 2, guide roll 3, a fabric take-up roll 4 and a weaver's stand 5. An optical scanning inspection station according to the invention is generally indicated at 6.

In the embodiment of FIG. 1, the scanning station comprises a vertical control stand formed by a number of guide rolls 7 over which the fabric 8 passes in order to define an inspection station 9 of the fabric which, in this embodiment, comprises two sections or runs A and B having a defined length along the warp and a width along the weft. The scanning station 6 includes a moveable optical sensor or scanner 10 which, by means of a device 11, is moveable over the entire inspection area A and B along a path 12. As will be described in connection with FIG. 3, sensor 10 can be moved along the inspection areas of a plurality of adjacent weaving machines.

The optical scanner 10 detects weaving irregularities in the fabric 8 in a manner known in the art. The scanner can observe the fabric by means of reflected light, but preferably a source of light is provided for, for instance a light box 13 between the inspection areas A and B at station 6, whereby the sensor 10 observes the fabric in front of transmitted light using one sensor.

Figure 2:
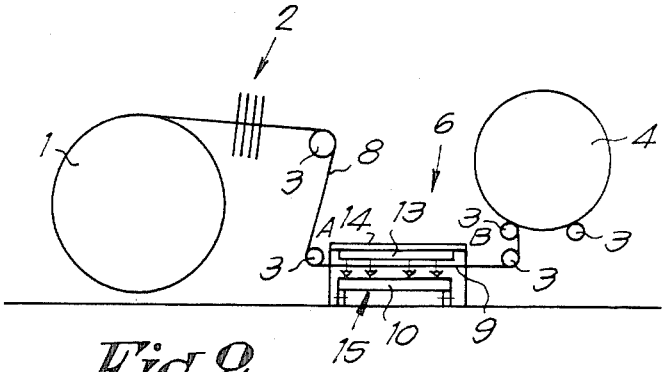
FIG. 2 illustrates schematically another embodiment of the invention wherein the inspection area is horizontally disposed beneath a weaver's platform.

According to the embodiment of FIG. 2, the inspection area 9 is horizontally disposed under the weaver's platform 14. The light box 13 is situated on the underside of the weaver's platform 14, while the optical sensor 10 is fixed on a small carriage 15 which can move back and forth under the weaver's platform 14.

This construction offers the advantage that the weaver is not hindered while carrying out his task by the inspection installation and in that a free sight on the weaving machines in the cloth mill is maintained. Another advantage consists in that the small carriage 15 can work with enormous speeds, particularly as it moves between the various weaving machines without exposing the weavers to a serious danger.

In operation, while the fabric 8 continually advances, sensor 10 scans (i.e., observes) the fabric in inspection areas A and B at a higher speed than the speed of the moving fabric. The observation can be effected in various ways. According to a first method, a point-by-point observation is carried out by moving sensor 10 back and forth in a zigzag pattern over the inspection area 9. According to another method, a sensor 10 is used which can observe simultaneously a complete width-wide section of the fabric in the inspection area. When the inspection area of the fabric has been scanned, the scanner moves toward the following or adjacent weaving loom to carry out a similar examination on the next loom. It goes without saying that the working speeds of the inspection station 6 (i.e., the scanner 10) are so adapted to the size of the inspection area 9 that a plurality of fabrics 8 from a plurality of weaving looms can be scanned by a sensor 10 without any area of the fabric 8 avoiding being scanned.

Figure 3:
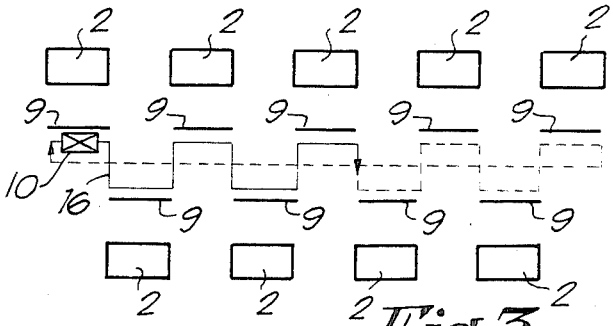
FIG. 3 schematically illustrates how a scanning of fabric on multiple looms can be carried out in accordance with the invention.

In FIG. 3, there is schematically illustrated a way in which the scanner 10 can move along a plurality of weaving looms 2 along a desired path 16 in order to reach and scan the various vertical inspection areas 9 of each loom 2. The sensor 10 is guided, for example, in a zigzag path 16 between the inspection areas 9 of a plurality of weaving looms 2. At each inspection area 9, the scanner 10 effects observation of the whole part A, B of each inspection area of each loom. The timing of scanner motion is such that it scans all the areas 9 in sequence and returns to the first loom during the time interval required for the fabric to advance the length of the first inspection area 9 on the first loom.

The weaving quality control signal generated by the sensor 10 is routinely compared with a weaving reference quality value that has been previously established. With a fabric 8 with patterns, a plurality of reference values would be used. When detecting a defect, the loom 2 is automatically signalled or stopped by the usual loom control system.

As schematically shown in FIG. 1, the inspection station 6 can also include a fabric storage holder 18 that can intermittently store a length of fabric 8 between the weaving part 2 of the loom and the inspection area 9 to provide a gain of time between full scans by sensor 10 so that it is possible to use one and the same sensor 10 for an even greater number of looms.

The present invention is not limited to the embodiments described, which should be considered as exemplary only. Devices constructed in accordance with this invention can be made with various shapes and dimensions in a manner known to those skilled in the art without departing from the spirit and scope of the present invention.

I claim:

1. A process for optically inspecting fabric woven in at least one loom between the weaving operation and the winding of the fabric on the take-up roll of the loom comprising:

(a) causing the fabric to extend over an inspection area having a defined length and width between the weaving of the fabric and the winding of same on a take-up roll of the loom;

(b) causing a moveable optical scanner to cyclically traverse the entire inspection area of said at least one loom during each inspection cycle and to generate weaving quality signals indicative of the weaving quality of the fabric extending over said inspection area;

(c) processing said weaving quality signals by at least comparing said weaving quality signals with previously established weaving quality reference values applicable to said loom and generating a weaving quality defect signal as a result of said processing whenever said comparison indicates a departure of the weaving quality signals from the weaving quality reference values.

2. A process according to claim 1, wherein said inspection area is defined by at least a single vertical run of fabric and said optical scanner is caused to move back and forth across the width of the inspection area and over its length during each inspection cycle.

3. A process according to claim 1, wherein said inspection area is defined by a pair of vertical runs of fabric arranged in sequence and wherein the optical scanner is caused to traverse the entire area of both runs during each inspection cycle.

4. A process according to claim 1, wherein the loom is provided with a weaver's platform beneath which the fabric runs between weaving and the take-up roll, and wherein said inspection area is located beneath said platform.

5. A process according to claim 1, including the step of generating a loom stopping control signal as a result of the generation of a weaving quality defect signal and controlling the running state of the loom, i.e., run or stop, in response to said loom stopping control signal.

6. A process for optically inspecting fabric woven on multiple, adjacent looms between the weaving operation on each loom and the take-up winding of the fabric on the take-up roll of each loom, comprising:

(a) causing the fabric woven on each loom to extend over an inspection area having a defined length and width between the weaving of the fabric and the winding of same on the take-up roll of each loom;

(b) causing a moveable optical scanner to cyclically traverse the entire inspection areas of each loom from first to last sequentially during each inspection cycle and to generate weaving quality signals indicative of the weaving quality of the fabric woven by each respective loom;

(c) processing said weaving quality signals at each loom by at least comparing said weaving quality signals with previously established quality reference values applicable to each respective loom, and generating a weaving quality defect signal for such loom as a result of such processing whenever said comparison indicates a departure of the weaving quality signal from the weaving quality reference value for such respective loom.

7. A process according to claim 6, including carrying out all the optical inspections of all looms from first to last so that the time for such inspection is the interval required for the fabric in the first loom to advance the length of an inspection area of the first loom, whereby all areas of the fabric moving through each loom are optically inspected within the time required to advance the woven fabric in the first loom over the length of its inspection area.

8. A process according to claim 6, including the step of generating a loom stopping control signal as a result of the generation of a weaving quality defect signal and controlling the running state of each loom, i.e., run or stop, in response to said stopping control signal.

9. An optical inspection system for inspecting fabric during weaving on a loom, the loom including a warp supply area, a weaving area, and a fabric take-up roll, comprising:

a fabric inspection station having a length and width disposed between the loom weaving area and the take-up roll of the loom;

a moveable scanner disposed at said inspection station arranged to traverse and view the entire inspection area during each inspection cycle;

guide rolls for guiding fabric in continuous runs over said inspection area for observation by said optical scanner.

10. The apparatus according to claim 9, wherein said inspection area is vertically oriented and includes means for guiding and supporting at least two continuous runs of fabric extending over said inspection area.

11. The apparatus according to claim 9, said loom including a horizontal weaver's platform, said inspection station extending horizontally between said weaver's platform, said optical scanner arranged to scan said horizontal inspection area.

12. The apparatus according to claim 9, including a fabric storage means between the weaving area and the inspection area of said loom, said storing means arranged to intermittently store lengths of fabric during operation of the loom in advance of said inspection area whereby motion of fabric lengthwise over the inspection area is intermittently delayed.

* * * * *